US008616488B2

(12) United States Patent
Wenk

(10) Patent No.: US 8,616,488 B2
(45) Date of Patent: Dec. 31, 2013

(54) AUTOMATIC EDGE GUIDE

(75) Inventor: Karl-Heinrich Wenk, Bad Nauheim (DE)

(73) Assignee: Applied Materials, Inc., Santa Clara, CA (US)

( * ) Notice: Subject to any disclaimer, the term of this patent is extended or adjusted under 35 U.S.C. 154(b) by 1202 days.

(21) Appl. No.: 12/128,059

(22) Filed: May 28, 2008

(65) Prior Publication Data

US 2009/0294570 A1 Dec. 3, 2009

(51) Int. Cl.
*B65H 26/06* (2006.01)

(52) U.S. Cl.
USPC ..... 242/563.1; 242/534.1

(58) Field of Classification Search
USPC ..... 242/563.1, 399.2, 534.1, 592
See application file for complete search history.

(56) References Cited

U.S. PATENT DOCUMENTS

| | | | | |
|---|---|---|---|---|
| 3,310,942 | A | 3/1967 | Stanford | |
| 3,767,131 | A * | 10/1973 | Ott, Jr. | 242/563.1 |
| 3,912,193 | A | 10/1975 | Calvaer | |
| 4,021,031 | A * | 5/1977 | Meihofer et al. | 226/20 |
| 4,054,251 | A * | 10/1977 | Henderson et al. | 242/563.1 |
| 4,077,579 | A * | 3/1978 | Seleski et al. | 242/563.1 |
| 5,664,738 | A * | 9/1997 | Fife | 242/563.1 |
| 5,938,098 | A * | 8/1999 | Fife | 226/19 |
| 2006/0011769 | A1 * | 1/2006 | Skuk et al. | 242/533 |
| 2009/0032196 | A1 * | 2/2009 | Skuk et al. | 156/538 |

FOREIGN PATENT DOCUMENTS

| | | |
|---|---|---|
| EP | 1619153 A1 | 1/2006 |
| EP | 1757548 A1 | 2/2007 |
| WO | WO-9942395 A1 | 8/1999 |

OTHER PUBLICATIONS

Extended European Search Report for Application No. 08157113.5-1256 dated Nov. 27, 2008.

* cited by examiner

*Primary Examiner* — Sang Kim
(74) *Attorney, Agent, or Firm* — Patterson & Sheridan, LLP

(57) ABSTRACT

A web winding up or unwinding device adapted for a web-form material coating machine comprises a web roll support, the web roll support comprising a web roll changing device, and a web edge guide device, the web edge guide device comprising a sensor device adapted for determining a shifting of a lateral edge of a web of the web-form material to be wound up on or unwound from the web roll arranged on the web roll support, a web roll support displacing device adapted for laterally displacing the web roll support, and a control device adapted for controlling the sensor device and the web roll support displacing device.

26 Claims, 5 Drawing Sheets

AUTOMATIC EDGE GUIDE

TECHNICAL FIELD OF THE INVENTION

The present invention relates to a web winding up or unwinding device, a web winding up or unwinding chamber device, and a method of winding up or unwinding a web. Particularly, the present invention relates to a web winding up or unwinding device adapted for a web-form material coating machine, a web winding up or unwinding chamber device for a web-form material coating machine, and a method of winding up or unwinding a web of a web-form material to be coated in a coating machine.

BACKGROUND OF THE INVENTION

In installations for coating a web-form material, typically a web of a synthetic film, a first web drum is unwound, the wound-off web is coated, for instance by sputtering, and the coated web is wound up again on a second web drum. When the first web drum has been fed out completely, it must be replaced by a new and full web drum. In addition, the coated web, which is completely wound-up on the second web drum, must also be removed and be replaced by an empty web drum. The term web drum is also referred to herein as web roll.

In known arrangements and methods for coating a web-form material, the steps of winding up and unwinding the web-form material are conducted in winding up and unwinding chambers being separated from the coating sites. For replacing the web drums, a crane may be used to remove the web drums out of the winding up and unwinding chambers and to introduce new web drums into the chambers from above.

Sometimes the uncoated fresh web-form material has not been wound up properly such that the lateral edges of consecutive layers of the film on the web drum are not positioned exactly on top of each other, resulting in a lateral winding deviation. Such a winding deviation, however, may result in an undesirably laterally shifted coating of the web-form material during coating processing. In addition, after coating processing the coated web-form material may be wound up in a laterally shifted way, which may be undesirable for a subsequent application of the coated web-form material.

SUMMARY

In light of the above, the web winding up or unwinding device according to independent claim 1, the web winding up or unwinding chamber device according to independent claim 4, and the method of winding up or unwinding a web of a web-from material according to independent claim 11 are provided.

In one embodiment it is provided a web winding up or unwinding device adapted for a web-form material coating machine, comprising a web roll support comprising a web roll changing device adapted for changing a web roll essentially outside a web winding up or unwinding chamber, and a web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device.

According to another embodiment, a web winding up or unwinding chamber device for a web-form material coating machine is provided, the chamber device comprising a web winding up or unwinding device, the web winding up or unwinding device comprising a web roll support, the web roll support comprising a web roll changing device adapted for changing a web roll essentially outside the chamber device, and a web edge guide device, the web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device.

Furthermore, in another embodiment a method of winding up or unwinding a web of a web-form material to be coated in a web-form material coating machine is provided, comprising winding up or unwinding a web on or from a web roll arranged on a web roll support in a web winding up or unwinding chamber, the web roll support comprising a web roll changing device for changing the web roll essentially outside the web winding up or unwinding chamber, and simultaneously monitoring by a sensor device the position of a lateral edge of the web to be wound up on or unwound from the web roll, and if a shifting of the lateral edge of the web is determined, guiding the lateral edge of the web by laterally displacing the web roll support in a direction opposite to the shifting of the lateral edge.

Further features and details are evident from the dependent claims, the description and the drawings.

Embodiments are also directed to apparatuses for carrying out the disclosed methods and including apparatus parts for performing described method steps. Furthermore, embodiments are also directed to methods by which the described apparatus operates or by which the described apparatus is manufactured. It may include method steps for carrying out functions of the apparatus or manufacturing parts of the apparatus. The method steps may be performed by way of hardware components, firmware, software, a computer programmed by appropriate software, by any combination thereof or in any other manner.

It is contemplated that elements of one embodiment may be advantageously utilized in other embodiments without further recitation.

BRIEF DESCRIPTION OF THE DRAWINGS

So that the manner in which the above recited features of embodiments of the present invention can be understood in detail, a more particular description may be had by reference to embodiments. The accompanying drawings relate to embodiments of the invention and are described in the following. Some of the above mentioned embodiments will be described in more detail in the following description of typical embodiments with reference to the following drawings in which.

DETAILED DESCRIPTION OF THE EMBODIMENTS

Figure 1:
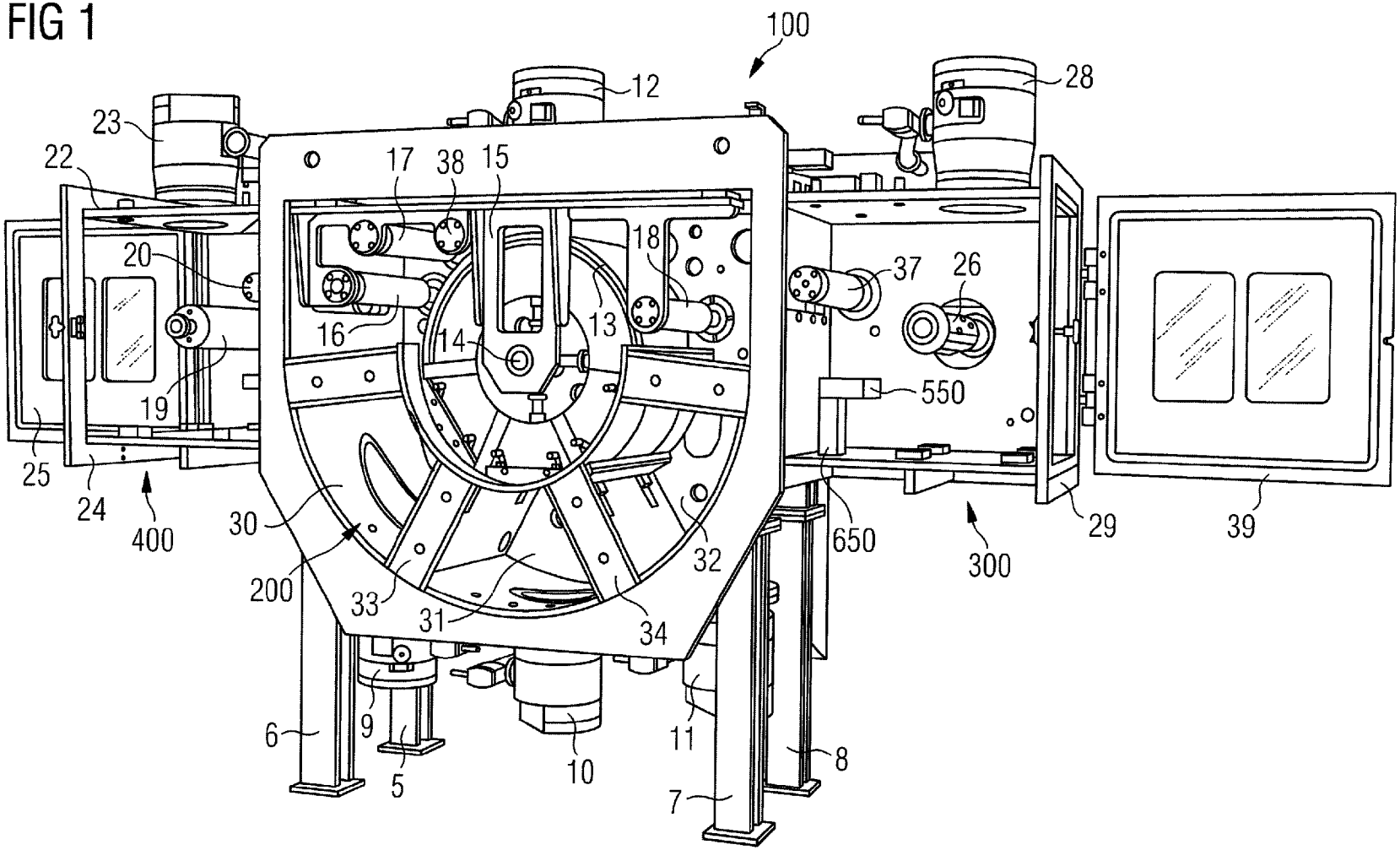
FIG. 1 shows a perspective view of a web-form material coating machine.

Reference will now be made in detail to the various embodiments, one ore more examples of which are illustrated in the figures. Each example is provided by way of explanation, and is not meant as a limitation of the invention. Within the following description of the drawings, the same reference numbers refer to the same components. Generally, only the differences with respect to the individual embodiments are described. Throughout the description and in the claims, the web winding up or unwinding chamber device may also be referred to as chamber device, web winding up or unwinding chamber, and chamber.

Typical applications of embodiments of the invention are in systems for coating of flexible web-form materials in a roll-to-roll process. Such systems may be, for instance, thin film deposition systems or clean room compatible vacuum web coaters. Examples of the web-form material to be coated are webs of synthetic films or of papers. The coating processing may for example be accomplished by sputtering or evaporation at vacuum conditions, for instance at a base pressure in the range of $10^{-7}$ mbar. Coating can also be effected by Plasma Enhanced Chemical Vapour Deposition at higher pressures than sputtering and evaporation. The coating material may typically be metallic, such as aluminum, polymeric or may include organic small molecules. The coating may also be polycrystalline or amorphous, such as polycrystalline or amorphous silicon. Therefore, embodiments of the invention are useful for example in vacuum web coaters for producing Flexible Printed Circuit Boards, flexible displays using Organic Light Emitting Devices, or flexible solar cells. Moreover, embodiments of the invention may be used in systems for producing metallized protective packaging materials, such as aluminum coated thin plastic films and papers. Embodiments of the invention can also be applied in other coating systems, for instance for depositing optical or magnetical layers or antireflective, conductive and/or dielectric coatings on flexible substrates, such as for the production of window films, printed circuit boards, touch panels, TV screens or other displays.

Without limiting the scope of the invention, the following is directed to a web winding up or unwinding device for a web-form material coating machine, a web winding up or unwinding chamber for a web-form material coating machine and a method of winding up or unwinding a web of a web-form material to be coated in a web-form material coating machine. Embodiments of the present invention can be applied to all kinds of systems for coating a flexible web-form material in a roll-to-roll process. Such systems are not limited to vacuum coating systems. As the person skilled in the art knows, the term "winding up" may be also referred to as "coiling" or "recoiling", and the term "unwinding" may be also referred to as "uncoiling". Likewise, the term "wind up" may be replaced by "coil" or "recoil", whereas the term "unwind" may be replaced by "uncoil". Furthermore, the "web roll" as mentioned herein may also be called "coil".

FIG. 1 illustrates as an example of embodiments a web-form material coating machine 100 including a coating chamber 200 supported on four columns 5 to 8. For evacuating the coating chamber 200, vacuum pumps 9 to 12 are provided. A coating cylinder 13 is mounted in the coating chamber 200 on a support 15. Guide rollers 16, 17, 18 and 38 are arranged in the coating chamber 200 for guiding a web-form material, i.e. a web, to be coated or having been coated, respectively. A sputtering cathode (not shown) for ejecting coating material is contained in the coating chamber 200. The coating chamber 200 includes several individual chambers 30 to 32, which are separated from each other by walls 33 and 34. According to the embodiment shown in FIG. 1, the web-form material coating machine 100 includes a winding up chamber 300 and an unwinding chamber 400, which are connected to the coating chamber 200.

Figure 2:
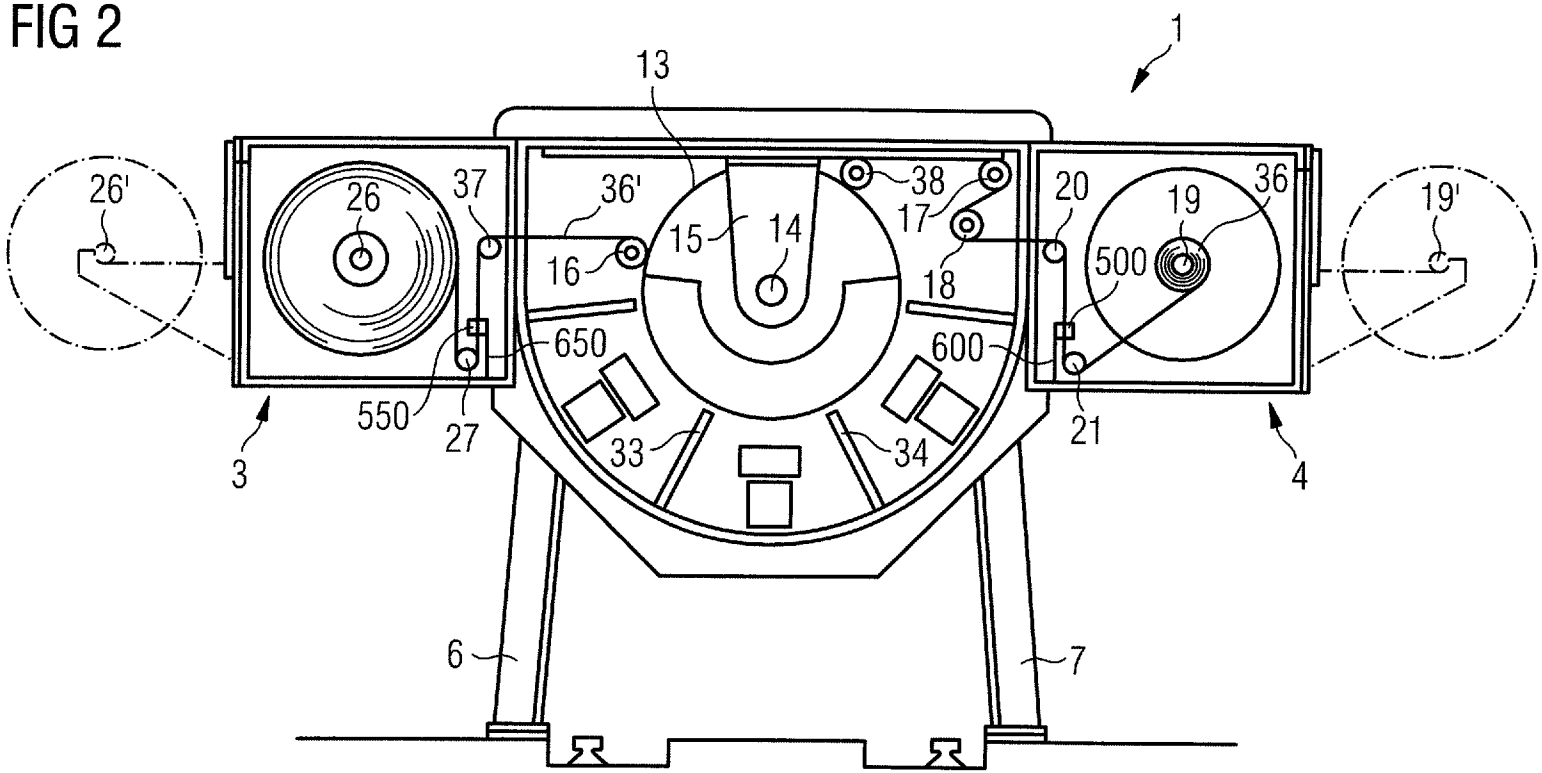
FIG. 2 is a schematic illustration of a web-form material coating machine, in which a web to be coated is transported from an unwinding chamber to a winding up chamber.

FIG. 2 illustrates a web-form material coating machine 1 according to an example of embodiments disclosed herein, in a schematic side view. According to the example shown therein, the web-form material coating machine 1 includes a winding up chamber 3 and an unwinding chamber 4, which are connected to a coating chamber 2. The web-form material coating machine 1 of FIG. 2 is mirror inverted as compared to the web-form material coating machine 100 of FIG. 1, such that the positions of the winding up chamber and the unwinding chamber are exchanged.

Figure 3:
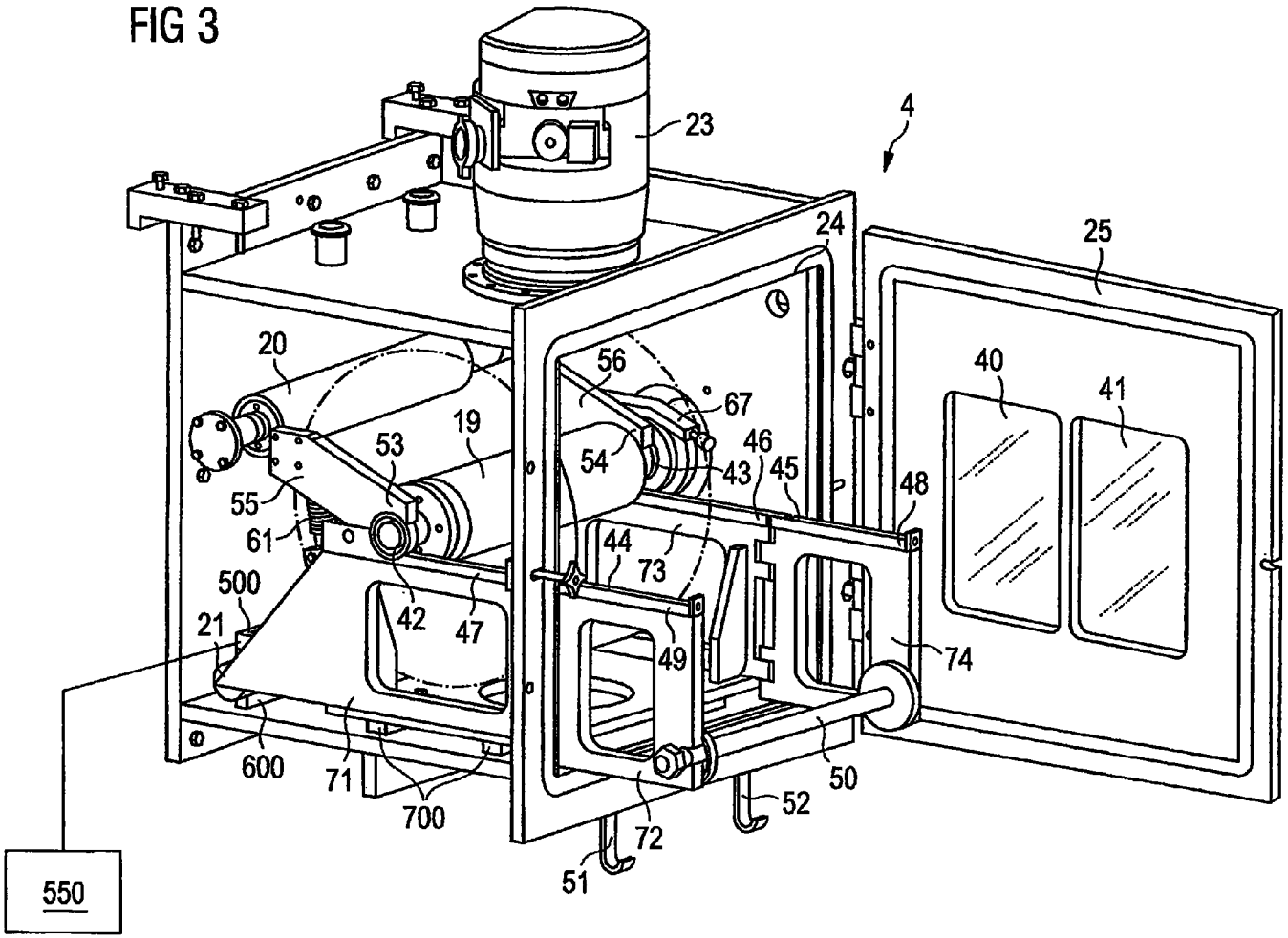
FIG. 3 is a perspective view of an unwinding chamber with the door open.

The unwinding chamber 4 is attached to the coating chamber 2 for feeding a web to be coated. The unwinding chamber 4 includes an unwinding cylinder 19 as a web roll and two guide rollers 20, 21. As shown in FIG. 3, on the top side 22 of the unwinding chamber 4 a vacuum pump 23 is provided, which is for evacuating the unwinding chamber 4. A feeding opening 24 of the unwinding chamber 4 is closable with a door 25.

The winding up chamber 3, which is mounted at the coating chamber 2 at the side opposite to the unwinding chamber 4, has a structure which corresponds to the structure of the winding up chamber 3 in a mirror-inverted way. Hence, it includes a winding up cylinder 26 as a web roll, guide rollers 27 and 37 and is provided with a vacuum pump (not shown). A feeding-out opening of the winding up chamber 3 is closable with a door.

The unwinding chamber 4 includes a web roll changing device, i.e. an arrangement for changing a winding cylinder. FIG. 3 illustrates an example of the unwinding chamber 4 in a perspective view. Typically, the web roll changing device has two guide rails to accommodate web roll bearings supporting a web roll, i.e. for receiving end bearings of a winding cylinder. Each of the guide rails is divided into a first and a second rail section, also referred to as guide rail sections. In each guide rail the first rail section is pivotable relative to the second rail section. Each first rail section is positioned essentially outside the chamber when pivoted into a web roll changing position. In this position, the first and the second rail section of each guide rail may be in line with each other. The effects of the web roll changing device as described herein is that the web roll can be changed outside the winding up or unwinding chamber 3 or 4, respectively, and/or can be introduced laterally into the winding up or unwinding chamber 3 or 4. According to a specific example of the web roll changing device, in the web roll changing position the first and second rail sections of each guide rail are arranged in a horizontal line.

Reference is made to the example of the unwinding chamber 4 as shown in FIG. 3; the web roll changing device of the unwinding chamber 4 includes two guide rails 44 and 45 each having two guide rail sections 46, 48 and 47, 49, respectively. The guide rail sections 46 and 47 are stationary and the other guide rail sections 48 and 49 are pivotable into a web roll changing position. In this position, the door 25 is open and each pivotable guide rail section 48 and 49 of the guide rails 44 and 45 is folded outwardly to project from the unwinding chamber 4 and to be in line with the stationary guide rail section 46 and 47, as shown in FIG. 3.

Above example of the unwinding chamber 4 will now be described in more detail referring to FIG. 3. The door 25 of the unwinding chamber 4 is provided with two glass windows 40, 41. The unwinding cylinder 19 includes at each of its ends one bearing 42, 43. Each of the bearings 42, 43 is guided by one of the guide rails 44, 45, disposed on the top side of a support 71, 72, 73, 74. The support 71, 72, 73, 74 is herein also referred to as web roll support and is divided into support sections 71, 72, 73, and 74. On the top side of the support sections 71, 73 the stationary guide rail sections 47, 46 are provided. The support sections 72, 74 support the pivotable guide rail sections 49, 48 and are each hinged to one of the support sections 71, 73, to be pivotable together with the guide rail sections 48, 49. Thereby, each guide rail section 48, 49 is foldable together with the corresponding support section 72, 74 into a closed position shown in FIG. 5. In the open position of the example shown in FIG. 3, the pivotable track sections 48, 49 and the pivotable support sections 74, 72 are secured with a rod 50. When the door 25 is closed, the rod 50 is not required and may be held in hooks 51, 52, which are attached beneath the unwinding chamber 4.

Figure 4:
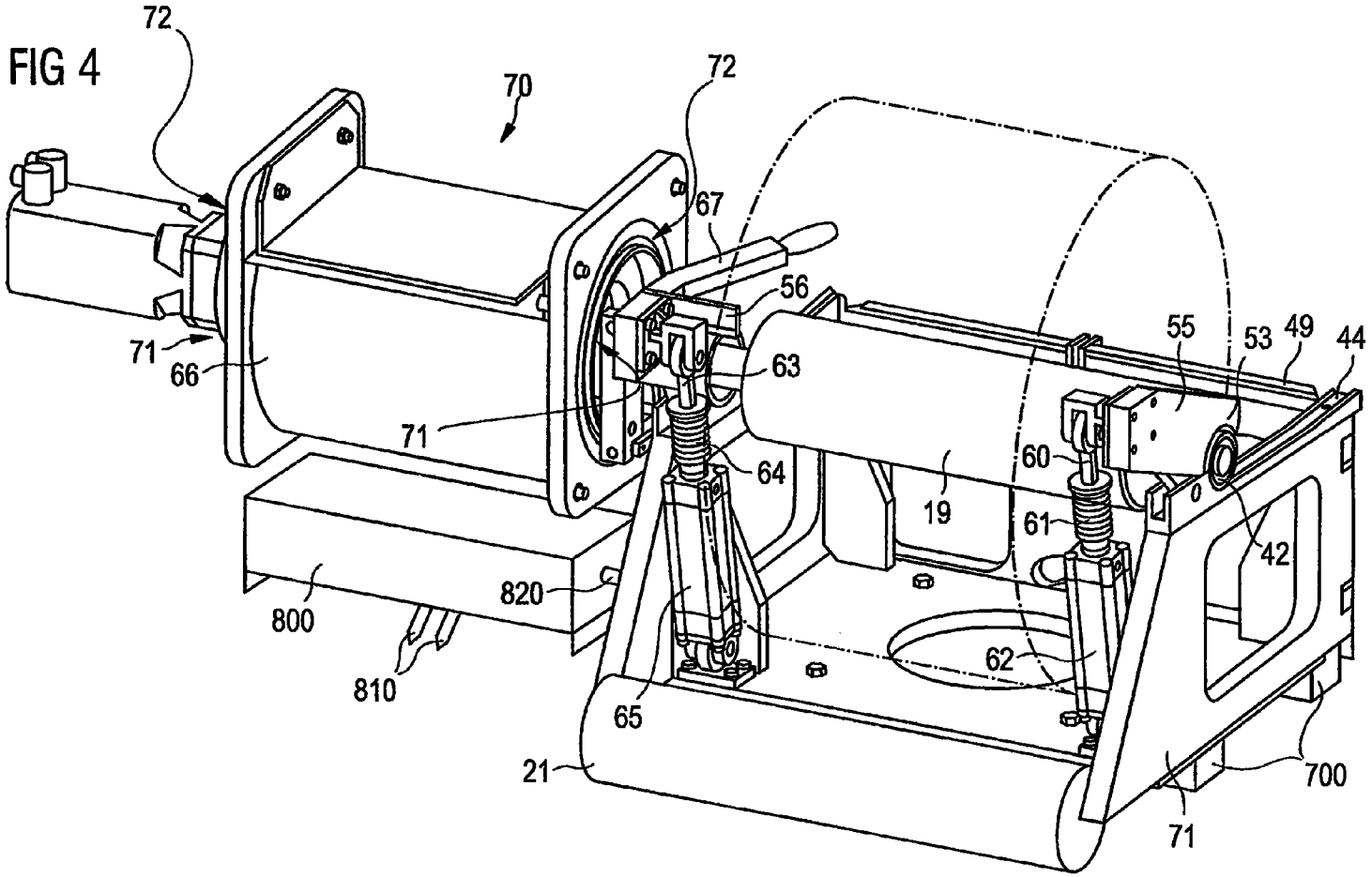
FIG. 4 shows a further perspective view of the unwinding chamber with a driving unit for a web roll.
Figure 5:
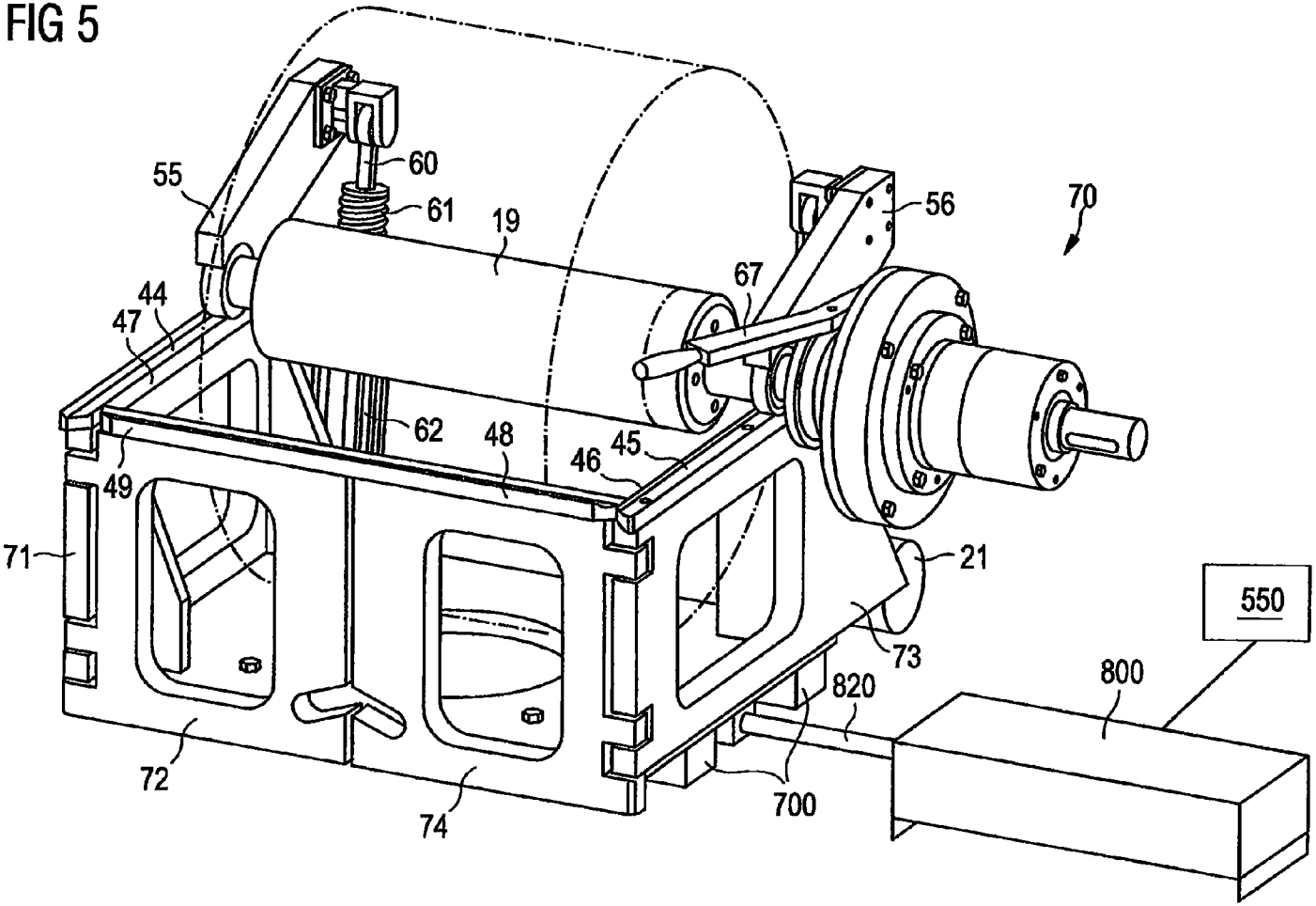
FIG. 5 is a perspective view of the unwinding chamber shown in FIGS. 3 and 4.

In the present example and as shown in FIGS. 3 to 5, guide roller 21 is supported on bearings (not shown) which are held at elongated lower edges of support sections 71 and 73. However, as the skilled person is aware, in an alternative of this example the bearings of guide roller 21 may also be supported at the two opposite side walls of the unwinding chamber 4.

The unwinding cylinder 19 of the above example of unwinding chamber 4 is arrested in its position shown in FIG. 3, since the bearings 42, 43 are each encompassed by a claw 53 and 54, respectively. Each claw 53, 54 is disposed at an end of an arm 55 and 56, respectively. Each arm 55 and 56 can be actuated by one of two pneumatic cylinders 62 and 65, which are shown in FIG. 4 in a perspective rear view of the unwinding chamber 4. For releasing the bearings 42, 43 of the unwinding cylinder 19, the arms 55, 56 may be raised by the pneumatic cylinders 62, 65. The arms 55, 56 are each connected at their rear ends with a piston 60, 63. Each piston 60, 63 extends through a spring 61 and 64, respectively, into the corresponding pneumatic cylinder 62, 65. The springs 61, 64 effect the closing force of the arms 55, 56.

As shown in FIGS. 4 and 5, for driving the unwinding cylinder 19, a driving unit 66 is provided at a lateral outer side of the unwinding chamber 4, attached at the sidewall of the unwinding chamber 4 via a vacuum-tight flange. The driving unit 66, which is herein also referred to as web roll driving unit, may be connected to a central axis of the unwinding cylinder 19 by a coupling 70, which is also referred to herein as a web roll coupling and is switchable via a coupling lever 67.

If the unwinding cylinder 19 is to be replaced in the unwinding chamber 4, the door 25 is opened and the pivotable guide rail sections 49 and 48 on support sections 72 and 74, respectively, are folded outwardly until they are in line with the corresponding stationary guide rail sections 46 and 47. Then the unwinding cylinder 19 is released from the claws 53 and 54 by actuating arms 55 and 56. After that the unwinding cylinder 19 is horizontally slid onto the projecting guide rail sections 48, 49 and removed. A new unwinding cylinder 19 provided with a fresh uncoated web is arranged on the projecting guide rail sections 48 and 49. The new unwinding cylinder is horizontally slid into the unwinding chamber 4 and arrested in its operating position by claws 53, 54. Finally, the pivotable guide rail sections 48 and 49 are folded back and the door 25 is closed.

Since the structure of the winding up chamber 3 may be mirror-inverted with respect to the structure of the unwinding chamber 4, only the structure of the unwinding chamber 4 is described herein in detail. From this description, the skilled person will easily determine the structure of the winding up chamber 3. Furthermore, it is apparent for the skilled person that the winding up cylinder 26 is exchanged in an analogous way as described for the unwinding cylinder 19.

Based on FIG. 2, an exemplary operation of the coating machine 1 will now be described. An empty winding up cylinder 26 is introduced into the winding up chamber 3 by opening its door, unfolding the corresponding pivotable guide rail sections and arranging thereon the empty winding up cylinder 26 in a position 26' outside the winding up chamber 3. Then, the empty winding up cylinder 26 is horizontally moved from the position 26' to its operating position inside the winding up chamber 3. For installing an unwinding cylinder 19 supporting an uncoated web, herein also referred to as film 36, the door 25 of the unwinding chamber 4 is opened and the guide rail sections 48 and 49 are unfolded. The unwinding cylinder 19 is arranged on the unfolded guide rail sections 48 and 49 and is moved horizontally from a position 19' outside the unwinding chamber 4 to its operating position 19. Thereafter, all projecting guide rail sections are folded back, the doors of the winding up and unwinding chambers 3 and 4 are closed and the chambers 2 to 4 are evacuated for starting the coating process. The uncoated film 36 runs over the guide rollers 21, 20, 18, 17 and 38 to the underside of the coating cylinder 13, where it is coated. The coated web, herein also referred to as film 36', leaves the coating chamber 2 via guide rollers 16, 37 and 27, to be finally wound up at the winding up cylinder 26. After the coated film 36' is fully transferred to the winding up cylinder 26, the latter is removed from the winding up chamber 3 by opening its door, unfolding the corresponding pivotable guide rail sections and transporting the winding up cylinder 26 to the position 26'. There the full winding up cylinder 26 is replaced by another empty winding up cylinder. Likewise, the empty unwinding cylinder 19 is exchanged by opening the door 25 of unwinding chamber 4, unfolding the guide rail sections 48 and 49, transporting the empty unwinding cylinder 19 to the position 19' and replacing it there by an unwinding cylinder which supports a wound-up uncoated film, as described above.

In some instances, the uncoated film 36 installed in the unwinding chamber 4, which includes the above web roll changing device for changing the web roll essentially outside the unwinding chamber, has been wound up on the unwinding cylinder 19 in a laterally shifted way, resulting in a lateral winding deviation. Therefore, during coating processing in the coating chamber 2, the coating may be undesirably applied on the film in a laterally shifted way. In addition, for some subsequent applications of the coated film, after coating a winding deviation has to be avoided during winding up of the coated film 36' in the winding up chamber 3, which includes the above mentioned web roll changing device for changing the web roll essentially outside the winding up chamber. Therefore, the unwinding chamber 4 and/or the winding up chamber 3 include a web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device. In this context, the term lateral edge refers to an edge of the web extending in parallel to the winding direction and/or to the transport direction of the web. Moreover, laterally shifting or laterally displacing is meant to indicate a direction of shifting or displacing, which is perpendicular to the winding and transport direction of the web.

In FIG. 3 to 5 an example of typical embodiments of the web edge guide device is illustrated. Again, only the structure of a web edge guide device provided in the unwinding chamber 4 is described herein. As will be understood by the skilled person, an additional web edge guide device may be arranged in the winding up chamber 3 in a mirror-inverted fashion as compared to the web edge guide device illustrated in FIG. 3 to 5.

As shown in FIG. 3, the sensor device includes a sensor 500 positioned in relation to the web roll support 71 to 74 such that the position of a lateral edge of the web or film to be wound up on or unwound from the web roll arranged on the web roll support is monitored. The sensor 500 of the web edge guide device is attached to a holder 600 mounted at the bottom of the unwinding chamber 4 at one side of the guide roller 21. In one typical embodiment, the sensor 500 is a sensor, typically including a photo sensor, formed as a bracket and being able to monitor the position and a shifting of a lateral web edge encompassed by the bracket during transport of the corresponding web. Alternatively, sensor 500 may include a photo-electric guard or a photo-electric barrier. The sensor 500 is located in a height above the guide roller 21 such that the lateral edge of the unwound web is positioned within the bracket of the sensor 500 with an appropriate clearance, when transported from the guide roller 21 to the guide roller 20. Furthermore, in this example of embodiments, the sensor 500 is connected to a control unit (not shown in FIGS. 2 to 5), which controls the operation of the sensor 500 and evaluates the data of the position of the web edge, which are acquired by the sensor 500 and sent to the control device 550.

In addition, according to the example of FIG. 2 to 5, the web roll support 71 to 74 is supported by at least two bearings (not shown), typically linear bearings, each bearing including a linear track 700 extending in parallel to a longitudinal axis of the web roll, i.e. in this case the unwinding cylinder 19. This arrangement allows for a lateral displacement of the web roll support 71 to 74 while providing a suitable guidance. The linear tracks 700 are mounted at the bottom of the unwinding chamber 4. The lateral dimensions of the web roll support 71 to 74, i.e. its width in the direction perpendicular to the winding or transport direction of the web, are such that a lateral clearance within the unwinding chamber 4 is provided. This lateral clearance allows a lateral displacement of the web roll support 71 to 74 of typically up to about +/−20 mm, more typically about +/−10 mm, most typically about +/−5 mm, by moving it on the tracks 700 for compensating a lateral winding shifting of the web unwound from the unwinding cylinder 19.

The web edge guide device of the present example further includes a web roll support displacing device comprising a linear actuator 800 and a setting piston 820 which is operably connected to the linear actuator 800. The setting piston 820 is laterally attached to the web roll support 71 to 74 and extends in parallel to a longitudinal axis of the web roll, i.e. in the present example in parallel to the central axis of the unwinding cylinder 19. The linear actuator 800 and the setting piston 820 are shown in FIG. 3 to 5 as being provided at the lateral outer side of the unwinding chamber beneath the driving unit 66. However, the linear actuator 800 and the setting piston 820 may alternatively be positioned at the side of the unwinding chamber 4, which is opposite to the side the driving unit 66 is attached to. The setting piston 820 is flanged at the unwinding chamber 4 in a vacuum tight way. The setting piston 820 may for instance be formed as a telescope bar, the length of which may be changed by the linear actuator 800. The linear actuator 800 is controlled by the above mentioned control unit. Therefore, the web edge guide described herein may be called an automatic web edge guide.

In the example shown in FIG. 3 to 5, the web roll coupling, i.e. the coupling 70 of the driving unit 66 is a flexible coupling. The coupling 70 comprises a clutch 72 connected to the web roll driving unit. The clutch is typically adapted for operably accommodating a web roll gear 71 connected to the web roll with a clearance of typically up to about 41 mm, more typically about 21 mm, most typically about 11 mm, in parallel to the longitudinal axis of the web roll. The clutch and/or the web roll gear may be formed of a plastic material. This structure allows for a displacement of the web roll gear inside of the clutch in accordance with a lateral movement of the web roll support. An example of a plastic material suitable in this example is typically a Nylon material, more typically Bovex™. Hence, during a lateral displacement of the web roll support 71 to 74, the web roll gear of coupling 70 may be displaced by typically up to about +/−20 mm, more typically about +/−10 mm, most typically about +/−5 mm, within the clutch of the coupling and in parallel to the longitudinal axis of the web roll. Therefore, when web roll support 71 to 74 is laterally displaced, the web roll gear of coupling 70 is still operably linked to the clutch, in order to be securely driven by the driving unit 66.

A web winding up or unwinding device or a web winding up or unwinding chamber of examples or embodiments described herein may be operated according to the following method of winding up or unwinding a web of a web-form material to be coated in a web-form material coating machine. This method comprises winding up or unwinding a web on or from a web roll arranged on a web roll support in a web winding up or unwinding chamber, the web roll support comprising a web roll changing device for changing the web roll essentially outside the web winding up or unwinding chamber, and simultaneously monitoring by a sensor device the position of a lateral edge of the web to be wound up on or unwound from the web roll, and if a shifting of the lateral edge of the web is determined, guiding the lateral edge of the web by laterally displacing the web roll support in a direction opposite to the shifting of the lateral edge.

One example of embodiments of above method will be illustrated in more detail, based on the exemplary operation of the coating machine 1 described above referring to FIG. 2. In this operation, after installation of the unwinding cylinder 19 supporting the uncoated film 36 and of the empty winding up cylinder 26, all guide rail sections projecting from the unwinding and winding up chambers 3 and 4 are folded back. The uncoated film 36 is fed in, the doors of the winding up and unwinding chambers 3 and 4 are closed and the chambers 2 to 4 are evacuated for starting the coating process. The uncoated film 36 runs over the guide rollers 21, 20, 18, 17 and 38 to the underside of the coating cylinder 13, where it is coated. The sensor 500 of the web edge guide mounted in the unwinding chamber 4 monitors the lateral edge of the uncoated film 36, which is passed through the inner space of the bracket of the sensor 500 when running from guide roller 21 to guide roller 20. The signals of the sensor 500 are transmitted to the control device and evaluated therein. In case that the control device 550 recognizes an undesired lateral shift of the lateral edge of the film 36, it activates the linear actuator 800, which actuates the setting piston 820. The setting piston 820 moves the web roll support 71 to 74 laterally on its bearings along the linear tracks 700 in a direction opposite to the shifting of the lateral edge. In the present example, guide roller 21 is mounted at support sections 71 and 73 and is therefore laterally shifted along with web roll support 71 to 74. The extent and duration of the lateral displacement of the web roll support 71 to 74, which is necessary for compensating the lateral shift of the film edge, has been determined and is transmitted to the actuator 800 by the control device according to computation the skilled person is familiar with. At the same time, the gear of the flexible coupling 70 connecting the unwinding cylinder 19 and the driving unit 66 is operably displaced within the clutch of the flexible coupling 70 corresponding to the lateral movement of the web roll support 71 to 74. The driving unit 66 may also be controlled by the above mentioned control unit for adapting the unwinding speed, when necessary.

As a result of above process, the uncoated film 36 is fed into the coating chamber 2 in an alignment necessary to apply the coating in a correct position on the film 36, avoiding an undesired lateral shifting of the coating layer. Then the film 36 is coated. The coated film 36' leaves the coating chamber 2 via guide roller 16 to be transferred into the winding-up chamber 3 via the guide rollers 37 and 27 to be finally wound up at the winding up cylinder 26.

In order to avoid a laterally shifted winding up of the coated film 36' on the winding up cylinder 26, an additional web edge guide device as described above may be installed in the winding up chamber 3. As is apparent for the skilled person, the arrangement of the web edge guide device in the winding up chamber 3 may be mirror-inverted as compared to the web edge guide device installed in the unwinding chamber 4, as indicated in FIG. 2. The sensor will then be positioned above the guide roller 27 for monitoring the position of the lateral edge of the coated film 36' when being transferred from guide roller 37 to guide roller 27.

After the coated film 36' is fully transferred to the winding up cylinder 26, the latter is removed from the winding up chamber 3 by opening its door, unfolding the corresponding pivotable guide rail sections and transporting the winding up cylinder 26 to the position 26' indicated in FIG. 2. There the full winding up cylinder 26 is replaced by another empty winding up cylinder. Likewise, the empty unwinding cylinder 19 is exchanged by opening the door 25, unfolding the guide rail sections 48 and 49, transporting the empty unwinding cylinder 19 to the position 19' and replacing it there by an unwinding cylinder which supports a wound-up uncoated film.

Above described embodiment of a method utilizes a web winding up device as well as a web unwinding device each including a web edge guide device according to embodiments disclosed herein. Hence, in case that the uncoated fresh web-form material has not been wound up properly, this winding deviation is compensated by the web edge guide device of the unwinding chamber. Therefore, during coating processing an undesirably laterally shifted coating of the web-form material is avoided. In addition, after coating processing the coated web-form material may be wound up such that the lateral edges of consecutive layers of the film on the web drum are positioned exactly on top of each other. Thereby, a winding deviation of the wound up coated web-form material is avoided. However, in other examples of embodiments disclosed herein, only the unwinding chamber 4 may be provided with a web edge guide device, thus including a web unwinding device being able to compensate winding deviations as described above. Alternatively, in yet other examples of embodiments disclosed herein, only the winding up chamber 3 may be provided with a web edge guide device.

Furthermore, it will be understood by those skilled in the art that in the above embodiments the coating machine 1 will be designed for webs or films, respectively, of specific dimensions and materials and for specific coating materials. Therefore, the dimensions of the web winding up or unwinding device or of the a web winding up or unwinding chamber and the features of the corresponding winding up or unwinding method can be specifically adjusted to those dimensions and/or materials of the web to be coated. Thus, by knowing the dimensions and/or the materials of the webs for which the coating chamber and the coating method is designed, the skilled person can determine the suitable dimensions of the web winding up or unwinding device and/or of the web winding up or unwinding chamber and the suitable features of the corresponding winding up or unwinding method such that a suitable winding up and/or unwinding of the webs is achieved. Moreover, it will be understood by those skilled in the art that in other examples of a coating machine in both or in only one of an unwinding chamber and a winding up chamber a web edge guide device as described above may be installed, depending on the production requirements.

In one embodiment it is provided a web winding up or unwinding device adapted for a web-form material coating machine, comprising a web roll support comprising a web roll changing device adapted for changing a web roll essentially outside a web winding up or unwinding chamber, and a web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device.

In a modification of the above embodiment, the sensor device comprises a sensor being positioned relative to the web roll support such that the position of the lateral edge of the web to be wound up on or unwound from the web roll arranged on the web roll support is monitored during winding up or unwinding.

In a modification of any of the above embodiment and modification, the web roll support is supported by at least two bearings, each bearing being guided by a linear track extending in parallel to a longitudinal axis of the web roll.

In a modification of any of the above embodiment and modifications, the web roll support displacing device comprises a linear actuator and a setting piston operably connected to the linear actuator, the setting piston being laterally attached to the web roll support and extending in parallel to a longitudinal axis of the web roll.

A modification of any of the above embodiment and modifications further comprises a web roll driving unit comprising a flexible web roll coupling, the web roll driving unit optionally being controlled by the control device.

In the above modification, the flexible web roll coupling may comprise a clutch connected to the web roll driving unit and adapted for operably accommodating a web roll gear connected to the web roll, the flexible web roll coupling comprising a plastic material. In addition or alternatively to comprising a plastic material, the flexible web roll coupling may be adapted to allow a shift of the web roll gear of +/−10 mm in parallel to a longitudinal axis of the web roll.

In a modification of any of the above embodiment and modifications, the web roll changing device comprises two guide rails to accommodate web roll bearings supporting a web roll, each of the guide rails being divided into a first and a second rail section, of which in each instance the first rail section is pivotable relative to the second rail section.

In a modification of any of the above embodiment and modifications, the web roll support may include a web guide roller positioned adjacent to the sensor device.

In a further embodiment it is provided a web winding up or unwinding chamber for a web-form material coating machine, the chamber comprising a web winding up or unwinding device, the web winding up or unwinding device comprising a web roll support, the web roll support comprising a web roll changing device adapted for changing a web roll essentially outside a web winding up or unwinding chamber, and a web edge guide device, the web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device.

In a modification of the above further embodiment, the chamber further comprises at least one element selected from the group consisting of: the web roll changing device comprising two guide rails to accommodate web roll bearings supporting the web roll, each of the guide rails being divided into a first and a second rail section, of which in each instance the first rail section is pivotable relative to the second rail, the web roll support including a web guide roller positioned adjacent to the sensor device, each first rail section being positioned essentially outside the chamber when pivoted into a web roll changing position wherein the first and the second rail section of each guide rail may be in line with each other, and a door for closing the chamber.

In a modification of any of the above further embodiment and modification thereof, the sensor device comprises a sensor being positioned in the chamber such that the position of the lateral edge of the web to be wound up on or unwound from the web roll arranged on the web roll support is monitored during winding up and unwinding.

In a modification of any of the above further embodiment and modifications thereof, the web roll support is supported by at least two bearings, each bearing being guided by a linear track provided in the chamber and extending in parallel to a longitudinal axis of the web roll.

In a modification of any of the above further embodiment and modifications thereof, the web roll support displacing device comprises a linear actuator and a setting piston operably connected to the linear actuator, the setting piston being laterally attached to the web roll support and extending in parallel to a longitudinal axis of the web roll.

A modification of any of the above further embodiment and modifications thereof comprises a web roll driving unit comprising a flexible web roll coupling.

In the latter modification, the flexible web roll coupling may comprise a clutch connected to the web roll driving unit and adapted for operably accommodating a web roll gear connected to the web roll, the flexible web roll coupling comprising a plastic material. In addition or alternatively to comprising a plastic material, the flexible web roll coupling may be adapted to allow a shift of the web roll gear of +/−10 mm in parallel to a longitudinal axis of the web roll.

In a modification of any of the above further embodiment and modifications thereof, the control device is adapted for controlling the web roll driving unit.

According to yet another embodiment it is provided a method of winding up or unwinding a web of a web-form material to be coated in a web-form material coating machine, comprising winding up or unwinding a web on or from a web roll arranged on a web roll support in a web winding up or unwinding chamber, the web roll support comprising a web roll changing device for changing the web roll essentially outside the web winding up or unwinding chamber, and simultaneously monitoring by a sensor device the position of a lateral edge of the web to be wound up on or unwound from the web roll, and if a shifting of the lateral edge of the web is determined, guiding the lateral edge of the web by laterally displacing the web roll support in a direction opposite to the shifting of the lateral edge.

In a modification of the above yet another embodiment, the web roll changing device comprises two guide rails to accommodate web roll bearings supporting the web roll, each of the guide rails being divided into a first and a second rail section, of which in each instance the first rail section is pivotable relative to the second rail section.

In a modification of any of the above yet another embodiment and modification thereof, the method further includes at least one step selected from the group consisting of: changing the web roll essentially outside the web winding up or unwinding chamber, and closing the web winding up or unwinding chamber with a door.

In a modification of any of the above yet another embodiment and modifications thereof, the web roll support is supported by at least two bearings, each bearing being guided by a linear track extending in parallel to a longitudinal axis of the web roll.

In a modification of any of the above yet another embodiment and modifications thereof, the web roll support may include a web guide roller positioned adjacent to the sensor device.

In a modification of any of the above yet another embodiment and modifications thereof, the web roll support is displaced by a linear actuator and a setting piston driven by the linear actuator and being laterally attached to the web roll support, the setting piston extending in parallel to a longitudinal axis of the web roll.

A modification of any of the above yet another embodiment and modifications thereof may comprise driving the web roll by a driving unit comprising a flexible web roll coupling.

In the latter modification, the flexible web roll coupling may comprise a clutch connected to the web roll driving unit and adapted for operably accommodating a web roll gear connected to the web roll, the clutch being formed of a plastic material.

In a modification of any of the above yet another embodiment and modifications thereof, the control device controls on the basis of data received from the sensor device at least one step selected from the group of: the steps of monitoring and guiding the lateral edge of the web, and the step of driving the web roll.

In a modification of any of the above yet another embodiment and modifications thereof, the step of changing the web roll comprises pivoting each first rail section into a web roll changing position wherein the first and the second rail section of each guide rail may be in line with each other, moving the web roll along the guide rail onto the first rail section, removing the web roll, and arranging another web roll on the first rail section.

In the latter modification, the web roll changing position may be essentially outside the web winding up or unwinding chamber.

The written description uses examples to disclose the invention, including the best mode, and also to enable any person skilled in the art to make and use the invention. While the invention has been described in terms of various specific examples and embodiments, those skilled in the art will recognize that the invention can be practiced with modifications within the spirit and scope of the claims. Especially, mutually non-exclusive features of the examples and/or embodiments described above may be combined with each other. The patentable scope of the invention is defined by the claims, and may include other examples that occur to those skilled in the art. Such other examples are intended to be within the scope of the claims.

The invention claimed is:

1. A web winding up or unwinding device adapted for a web-form material coating machine, comprising a web roll support comprising a web roll changing device adapted for changing a web roll essentially outside a web winding up or unwinding chamber, and a web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device, wherein the web roll support includes a web guide roller positioned adjacent to the sensor device.

2. The device according to claim 1, wherein the sensor device comprises a sensor being positioned relative to the web roll support such that the position of the lateral edge of the web to be wound up on or unwound from the web roll arranged on the web roll support is monitored during winding up or unwinding.

3. The device according to claim 1, wherein the web roll support is supported by at least two bearings, each bearing being guided by a linear track extending in parallel to a longitudinal axis of the web roll.

4. The device according to claim 1, wherein the web roll support displacing device comprises a linear actuator and a setting piston operably connected to the linear actuator, the setting piston being laterally attached to the web roll support and extending in parallel to a longitudinal axis of the web roll.

5. The device according to claim 1, comprising a web roll driving unit comprising a flexible web roll coupling, the web roll driving unit optionally being controlled by the control device.

6. The device according to claim 5, the flexible web roll coupling comprising a clutch connected to the web roll driving unit and adapted for operably accommodating a web roll gear connected to the web roll, the flexible web roll coupling comprising a plastic material and being adapted to allow a shift of the web roll gear of +/−10 mm in parallel to a longitudinal axis of the web roll.

7. The device according to claim 1, wherein the web roll changing device comprises two guide rails to accommodate web roll bearings supporting a web roll, each of the guide rails being divided into a first and a second rail section, of which in each instance the first rail section is pivotable relative to the second rail section.

8. A web winding up or unwinding chamber for a web-form material coating machine, the chamber comprising a web winding up or unwinding device, the web winding up or unwinding device comprising a web roll support, the web roll support comprising a web roll changing device adapted for changing a web roll essentially outside the web winding up or unwinding chamber, and a web edge guide device, the web edge guide device comprising a sensor device adapted for determining a shifting of a lateral edge of a web of the web-form material to be wound up on or unwound from the web roll arranged on the web roll support during winding up or unwinding, a web roll support displacing device adapted for laterally displacing the web roll support, and a control device adapted for controlling the web roll support displacing device on the basis of data received from the sensor device, wherein the web roll support includes a web guide roller positioned adjacent to the sensor device.

9. The chamber according to claim 8, the chamber further comprising:

the web roll changing device comprising two guide rails to accommodate web roll bearings supporting the web roll, each of the guide rails being divided into a first and a second rail section, of which in each instance the first rail section is pivotable relative to the second rail.

10. The chamber according to claim 8, wherein the sensor device comprises a sensor being positioned in the chamber such that the position of the lateral edge of the web to be wound up on or unwound from the web roll arranged on the web roll support is monitored during winding up and unwinding.

11. The chamber according to claim 8, wherein the web roll support is supported by a least two bearings, each bearing being guided by a linear track provided in the chamber and extending in parallel to a longitudinal axis of the web roll.

12. The chamber according to claim 8, wherein the web roll support displacing device comprises a linear actuator and a setting piston operably connected to the linear actuator, the setting piston being laterally attached to the web roll support and extending in parallel to a longitudinal axis of the web roll.

13. The chamber according to claim 8, comprising a web roll driving unit comprising a flexible web roll coupling including a clutch accommodating a gear with a clearance of up to 41 mm for displacement corresponding to the lateral movement of the web roll support.

14. The chamber according to claim 13, the flexible web roll coupling comprising a clutch connected to the web roll driving unit and adapted for operably accommodating a web roll gear connected to the web roll, the flexible web roll coupling comprising a plastic material and being adapted to allow a shift of the web roll gear of +/−10 mm in parallel to a longitudinal axis of the web roll.

15. The chamber according to claim 8, wherein the control device is adapted for controlling the web roll driving unit.

16. The chamber according to claim 8, the chamber further comprising:

each first rail section being positioned essentially outside the chamber when pivoted into a web roll changing position wherein the first and the second rail section of each guide rail may be in line with each other.

17. The chamber according to claim 8, the chamber further comprising:

a door for closing the chamber.

18. A method of winding up or unwinding a web of a web-form material to be coated in a web-form material coating machine, comprising winding up or unwinding a web on or from a web roll arranged on a web roll support in a web winding up or unwinding chamber, the web roll support comprising a web roll changing device for changing the web roll essentially outside the web winding up or unwinding chamber, and simultaneously monitoring by a sensor device the position of a lateral edge of the web to be wound up on or unwound from the web roll, wherein the web roll support includes a web guide roller positioned adjacent to the sensor device, and if a shifting of the lateral edge of the web is determined, guiding the lateral edge of the web by laterally displacing the web roll support in a direction opposite to the shifting of the lateral edge.

19. The method according to claim 18, wherein the web roll changing device comprises two guide rails to accommodate web roll bearings supporting the web roll, each of the guide rails being divided into a first and a second rail section, of which in each instance the first rail section is pivotable relative to the second rail section.

20. The method according to claim 19, wherein the step of changing the web roll comprises pivoting each first rail section into a web roll changing position wherein the first and the second rail section of each guide rail may be in line with each other, moving the web roll along the guide rail onto the first rail section, removing the web roll, and arranging another web roll on the first rail section, wherein optionally the web roll changing position is essentially outside the web winding up or unwinding chamber.

21. The method according to claim 18, wherein the method further comprises: changing the web roll essentially outside the web winding up or unwinding chamber, and closing the web winding up or unwinding chamber with a door.

22. The method according to claim 18, wherein the web roll support further comprises at least two bearings supporting the web roll support, each bearing being guided by a linear track extending in parallel to a longitudinal axis of the web roll.

23. The method according to claim 18, wherein the web roll support is displaced by a linear actuator and a setting piston driven by the linear actuator and being laterally attached to the web roll support, the setting piston extending parallel to a longitudinal axis of the web roll.

24. The method according to claim 18, comprising driving the web roll by a driving unit comprising a flexible web roll coupling.

25. The method according to claim 24, wherein the flexible web roll coupling comprises a clutch connected to the web roll driving unit and adapted for operably accommodating a web roll gear connected to the web roll, the clutch being formed of a plastic material.

26. The method according to claim 18, wherein the control device controls on the basis of data received from the sensor device at least one step selected from the group of: the steps of monitoring and guiding the lateral edge of the web, and the step of driving the web roll.

* * * * *

UNITED STATES PATENT AND TRADEMARK OFFICE

CERTIFICATE OF CORRECTION

PATENT NO. : 8,616,488 B2
APPLICATION NO. : 12/128059
DATED : December 31, 2013
INVENTOR(S) : Karl-Heinrich Wenk It is certified that error appears in the above-identified patent and that said Letters Patent is hereby corrected as shown below:

In the Specification:

Column 1, Lines 47-52, please delete

"In light of the above, the web winding up or unwinding device according to independent claim 1, the web winding up or unwinding chamber device according to independent claim 4, and the method of winding up or unwinding a web of a web-from material according to independent claim 11 are provided.".

Signed and Sealed this
Fifteenth Day of April, 2014

Michelle K. Lee

Michelle K. Lee
*Deputy Director of the United States Patent and Trademark Office*